US007091437B2

(12) United States Patent
Yeh et al.

(10) Patent No.: US 7,091,437 B2
(45) Date of Patent: Aug. 15, 2006

(54) ROTARY SWITCH

(75) Inventors: Chen-Kuang Yeh, Taipei (TW); Fu-Lin Yang, Taipei (TW)

(73) Assignee: Premier Image Technology Corporation, Taipei (TW)

( * ) Notice: Subject to any disclaimer, the term of this patent is extended or adjusted under 35 U.S.C. 154(b) by 0 days.

(21) Appl. No.: 10/958,355

(22) Filed: Oct. 6, 2004

(65) Prior Publication Data

US 2006/0070863 A1 Apr. 6, 2006

(51) Int. Cl.
*H01H 19/00* (2006.01)

(52) U.S. Cl. ..... 200/571

(58) Field of Classification Search ..... 200/336, 200/292, 293, 341, 564, 345, 570, 571, 11 R, 200/11 DA, 11 C, 6 C
See application file for complete search history.

(56) References Cited

U.S. PATENT DOCUMENTS 4,166,200 A * 8/1979 Reichen et al. ..... 200/11 R
4,551,587 A * 11/1985 Rose ..... 200/11 R
4,625,084 A * 11/1986 Fowler et al. ..... 200/11 DA
5,010,214 A * 4/1991 Yamazaki ..... 200/6 B
5,153,391 A * 10/1992 Dzung et al. ..... 200/11 R
6,067,424 A * 5/2000 Shono ..... 200/336
6,175,091 B1 * 1/2001 Nishimura et al. ..... 200/571
6,262,378 B1 * 7/2001 Chou ..... 200/4
6,339,200 B1 * 1/2002 Shi et al. ..... 200/305
6,667,446 B1 * 12/2003 Schuberth et al. ..... 200/4

* cited by examiner

*Primary Examiner*—Lincoln Donovan
*Assistant Examiner*—M. Fishman
(74) *Attorney, Agent, or Firm*—Rosenberg, Klein & Lee

(57) ABSTRACT

A knob module is set on a circuit board of an electric device and comprises: a pedestal fixed on the circuit board with a plurality of interference parts and a pivotally connecting part; a rotative body with a plurality of pivotally connecting bodies corresponding to the pivotally connecting part and a plurality of interference bodies corresponding to the interference part, the rotative body is connected to the pedestal by pivotally connecting the pivotally connecting bodies with the pivotally connecting part, the interference bodies are interfered with the interference part, respectively; and, an elastically contacting piece is fixed on the rotative body, a first contacting part and a second contacting part of the elastically contacting piece are situated on the outer and inner circle of the pivot rod, the first contacting part and a second contacting part are electrically connected to corresponding places of the circuit board.

9 Claims, 4 Drawing Sheets

ROTARY SWITCH

BACKGROUND OF THE INVENTION

1. Field of the Invention

The present invention is related to a knob module, and especially to a module applied on electrical multi-media products made by different factories for being assembled quickly.

2. Description of Related Art

Prior art controlling knobs are made for function choices (as mode selection knobs for digital cameras or PDAs). Generally, the controlling knobs are designed for specific electrical products, and cannot be used for other products even though the products are all designed in the same factories. Therefore, a new mold for knobs is always needed when producing a new product.

Furthermore, the number of functions or modes is different between electrical products made by different factories. For this reason, a controlling knob isn't used for different electrical products.

Moreover, structures of prior art controlling knobs are too complicated and their cost too high.

SUMMARY OF THE INVENTION

The objectives of the present invention are to modularize controlling knobs, simplify the structure of the knobs thus allowing quick assembly, and lower the costs of production. Different factories or stores can only change the circuit design of the circuit board and set additional fixed holes for the same knobs. Furthermore, the knobs are preset with more option connecting points so that they can be the used with all electrical products.

The present invention provides a knob module set on a circuit board of an electrical product, and comprises:

a pedestal fixed on the circuit board with a plurality of interference parts and a pivotally connecting part;

a rotative body with a plurality of pivotally connecting bodies corresponding to the pivotally connecting part and a plurality of interference bodies corresponding to the interference part; the rotative body is connected to the pedestal by pivotally connecting the pivotally connecting bodies with the pivotally connecting part; the interference bodies interfer with the interference part, respectively; and an elastically contacting piece fixed on the rotative body; a first contacting part and a second contacting part of the elastically contacting piece are situated on the outer and inner circle of the pivot rod; the first contacting part and the second contacting part are electrically connected to corresponding places on the circuit board.

DETAILED DESCRIPTION OF PREFERRED EMBODIMENTS

Figure 1:
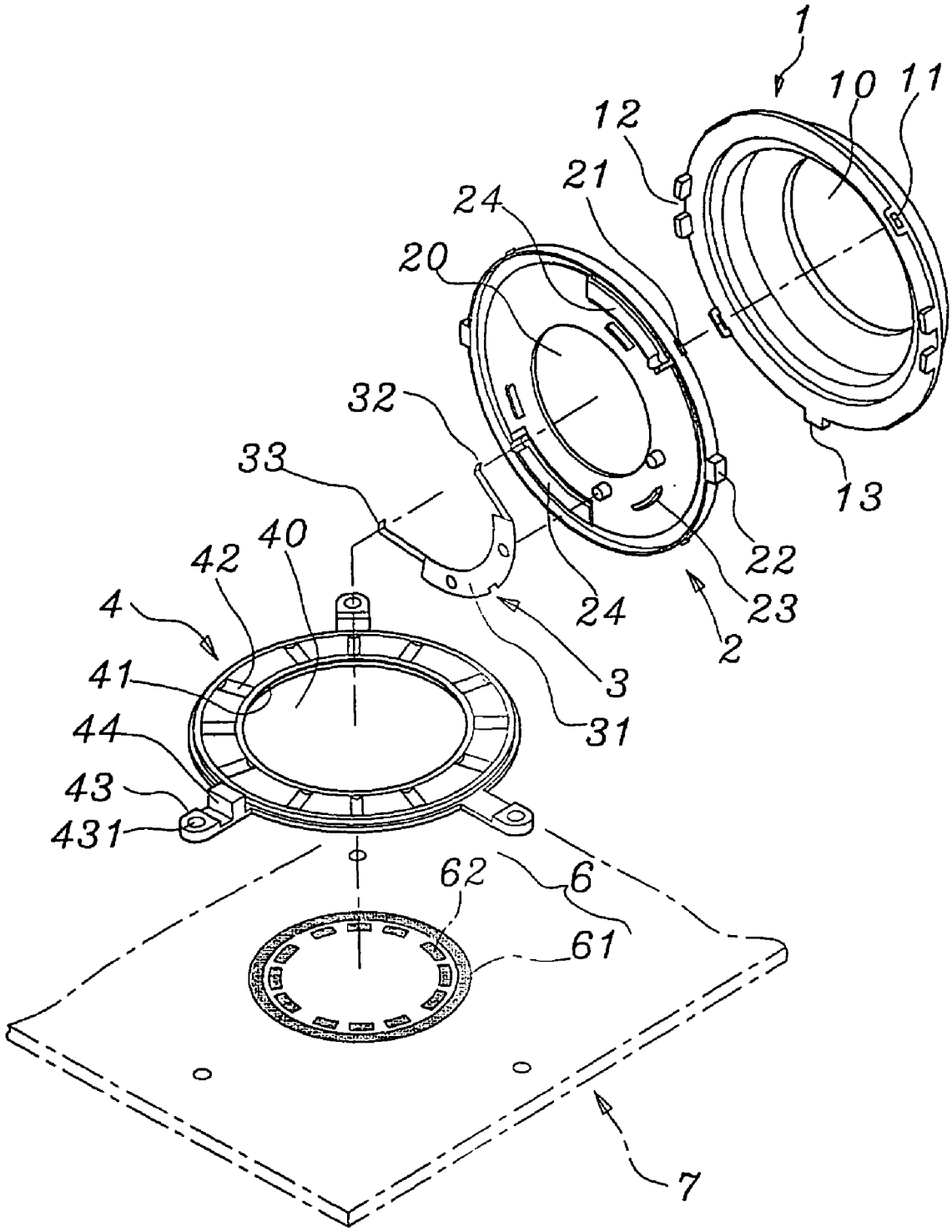
FIG. 1 shows an exploded view of a first embodiment of the present invention.
Figure 2:
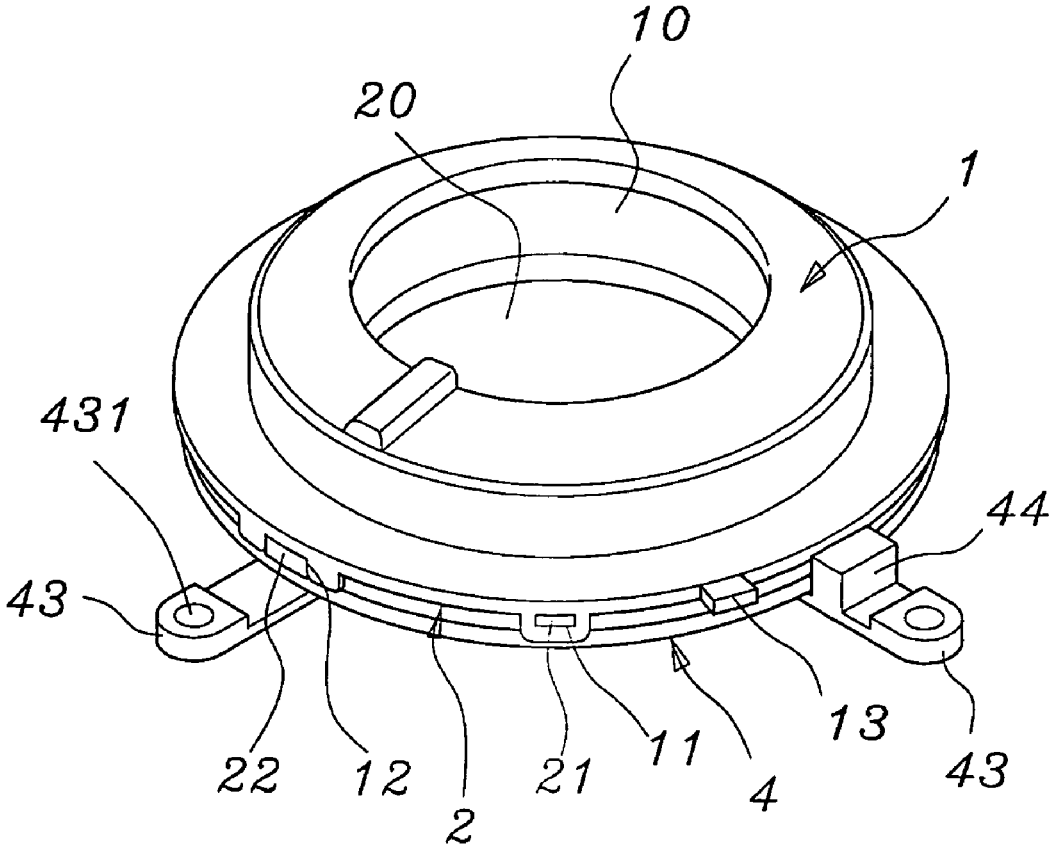
FIG. 2 shows a combination diagram of the first embodiment of the present invention.
Figure 3:
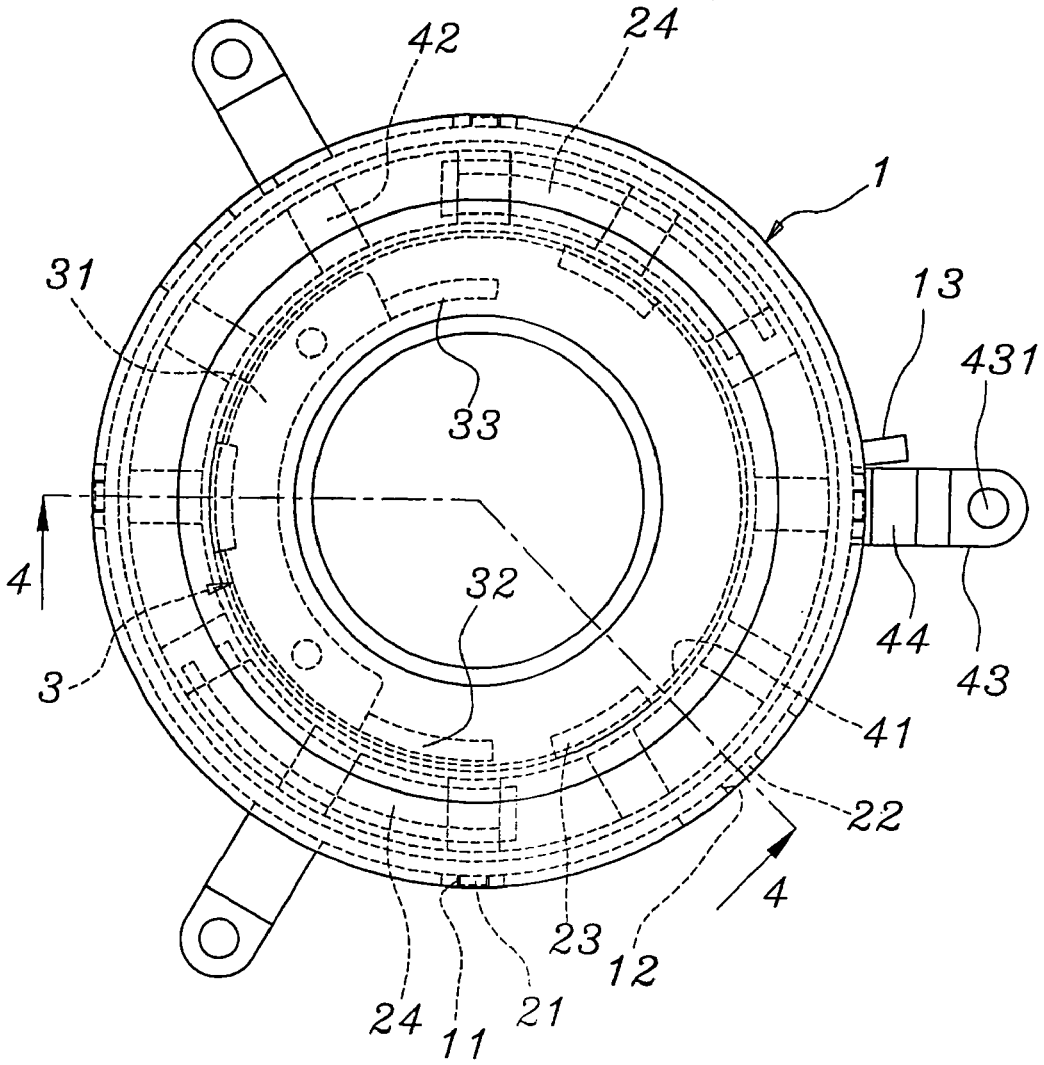
FIG. 3 shows a bird's eye view of the first embodiment of the present invention.
Figure 4:
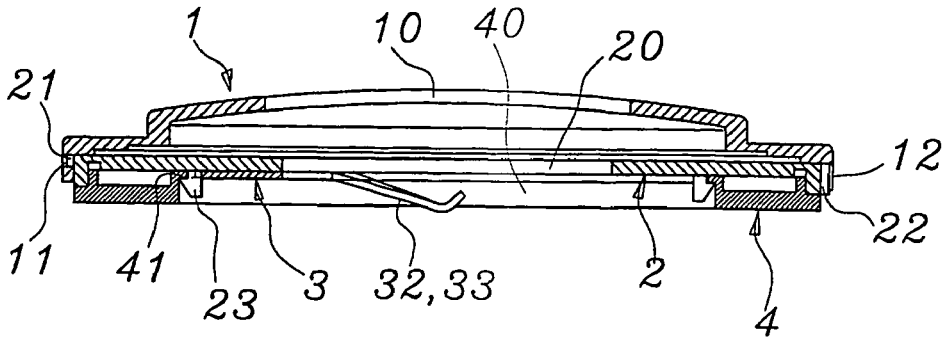
FIG. 4 shows a 4—4 cross-sectional view of the first embodiment of the present invention.

The first embodiment is shown in FIG. 1 to FIG. 4. The present invention provides a knob module which is modularized for being electrically set on a circuit board 7 of electric products, and the knob module provides various function selections and mode selections. The knob module mainly comprises a rotative body 2, an elastically connecting piece 3, and a pedestal 4. The module further comprises a shell 1 and a collocating structure 5 for improving the functions of the knobs.

The pedestal 4 is shaped into a hoop with a pierced hole 40 formed on the center of the pedestal 4 and a plurality of stretching parts 43 are protruded around the pedestal 4. Besides, every free terminal of the stretching part 43 has a corresponding hole 431 for fixing the pedestal 4 onto the circuit board 7 (by using spirally connecting units). A pivotally connecting part 41 with a circle of protruding edge type is formed at the upper part of the inner edge of the pierced hole 40, and a plurality of interference parts 42 in concave trench shapes circles around the pedestal 4. Moreover, a stop plate 44 is set protrudently on the stretching part 43 for stopping the rotating amplitude of the stretching part 43.

Further, the rotative body 2 includes a plurality of pivotally connecting bodies 23 corresponding to the pivotally connecting part 41 and a plurality of interference bodies 24 corresponding to the interference part 42. The rotative body 2 is connected to the pedestal 4 by pivotally connecting the pivotally connecting bodies 23 with the pivotally connecting part 41; the interference bodies 24 are interfered with the interference part 42 for producing a multi-stage rotating orientation effects. Besides, the pivotally connecting bodies set on the rotative body are preferably made of hooks corresponding to the protruding edge (pivotally connecting part 41). Therefore, the pivotally connecting part bodies 23 are all hooked on the pivotally connecting part 41 and the rotative body 2 can be pivotally connected to the pedestal 4 for rotation. The interference bodies 24 can be elastic arms and it comprises of at least one pair of elastic arms; the free terminals of the interference bodies of the elastic arms are interfered with the interference parts 42 to make multi-stage orientation effects.

Moreover, the elastically contacting piece 3 includes a fixed part 31 of the rotative body 2, a first contacting part 32 and a second contacting part 33; the first contacting part 32 and the second contacting part 33 are protruded at two terminals of the fixed part 31 and situated on the outer and inner circle of the pivot rod; the first contacting part 32 and a second contacting part 33 are also situated within the range of the pierced hole 40 of the pedestal 4; hence, the first contacting part 32 and a second contacting part 33 can electrically connect to a corresponding circuit 6 of the circuit board 7.

The circuit board 7 includes the corresponding circuit 6 which corresponds to the first contacting part 32 and the second contacting part 33. The corresponding circuit 6 includes a conducting hoop 61 and a plurality of connecting points 62 set in the inner the circle of the conducting hoop 61. The conducting hoop 61 is used for electrically contacting the first contacting part 32 (as a common electrode) and the connecting points 62 are used for electrically contacting with the second contacting part 33. Therefore, when the rotative body 2 is rotated, the first contacting part 32 will be constantly contacted with the conducting hoop 61; further, according to the rotation angle of the rotative body 2, the second conducting part 33 will contact with one of the connecting points for electrical conduction and some kind of mode or function will be thus activated. Moreover, when the rotative body 2 is rotating, the interference bodies 24 are interfered with by the interference parts 42 of the pedestal 4 in order; so, the number of interference parts 42 corresponds to the number of connecting points 62 and every section the rotative body rotates will produce an interfered orientation effect.

The present invention further comprises a shell 1 which is fixed to the rotative body 2. So the shell 1 can spin synchronously with the rotative body 2, a plurality of stop parts 12 and fixedly connecting parts 11 are set around the shell 1. A plurality of stop bodies 22 and fixedly connecting components 21 corresponding to the stop parts 12 and fixedly connecting parts 11 are set around the rotative body 2; the stop bodies 22 are stopped by the stop parts 12 for rotating the shell 1 synchronously with the rotative body 2 and the fixedly connecting components 21 are connected to the fixedly connecting parts 11 for connecting the shell 1 with the rotative body 2. Furthermore, for limiting the rotation amplitude of the shell 1 and the rotative body 2, the shell 1 further includes a projection 13 and a stop plate 44 which is set on the stretching part 43; the stop plate 43 is positioned in the rotating path of the projection 13 for stopping the rotation of the shell 1 as well as the rotative body 2.

However, in FIGS. 1 to 4, a pierced hole 10 and a pierced hole 20 exist on the shell 1 and the rotative body 2. Because the pierced hole 10 and the pierced hole 20 are used for the collocating structure 5, they do not appear in the first embodiment and can be sealed.

Figure 5:
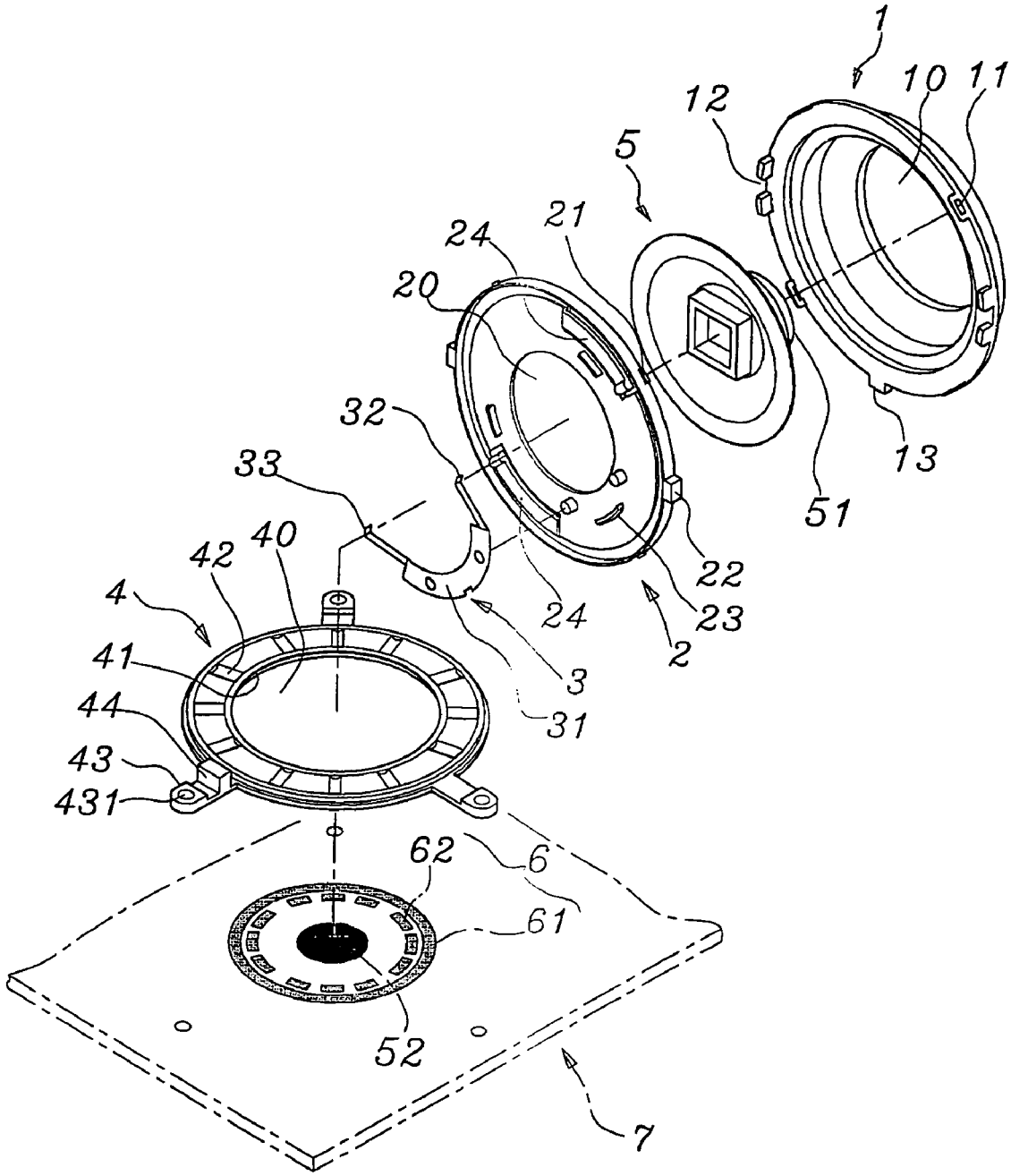
FIG. 5 shows an exploded view of a second embodiment of the present invention.

Please refer to a second embodiment in FIG. 5, it mainly shows a collocating structure 5 set between the shell 1 and the rotative body 2. With the additional structure, the functions of the knob module are increased. Owing to the fact that the collocating structure 5 is set between the shell land the rotative body 2, pierced holes 10, 20 are set on the shell 1 and the rotative body 2, respectively. The collocating structure 5 protrudes partly to the pierced hole 10 of the shell 1 and electrically connects to a corresponding part of the circuit board 7 through the pierced hole 20 of the rotative body 2. For example, the collocating structure 5 can include an operation body 51 set between the shell 1 and the rotative body 2, and a multi-direction switching body 52 connected electrically to the circuit board 7; the operating body 51 is connected to the multi-direction switching body 52 mechanically and thus the multi-direction switching function is added to the present invention.

The present invention modularizes the prior art controlling knobs. Hence, only change of the circuit design (corresponding circuit 6) and additional fixed holes (not labeled) on the circuit board 7 for fixing the pedestal 4 are needed, and the knobs can be used by every electrical product that uses knobs. Further, the structure of the knob module is simplified for lowering production costs and quick assembly. Moreover, enough optional connecting points (twelve connecting points 62 are shown in the figure) are preset on the knob module, and the number of the connecting points surpasses the demand of electrical products on knobs. However, unnecessary connecting points 62 will not be electrically connected to the circuit board 7 and a collocating structure 5 is added for raising the functions of the module.

What is claimed is:

1. A rotary switch, being set on a circuit board of an electric device, comprising:

a pedestal, being fixedly coupled to the circuit board, and having a plurality of interference parts formed thereon and a pivotal-connecting part formed on a central portion thereof;

a rotative body, having a plurality of pivotal-connecting bodies extending from a bottom surface thereof, and at least one elastic arm formed integrally with and extending from said bottom surface of said rotative body, the elastic arm having a free end, wherein the pivotal-connecting bodies are formed on a circle centered along an axis of the rotative body and are pivotally assembled with the pivotal-connecting part of the pedestal, and the free end of the elastic arm being in elastic contact with one of the interference parts; and an elastic-contacting piece, fixed on the bottom surface of the rotative body, and extending with a first contacting part and a second contacting part located on two circles centered along an axis of the rotative body, the first contacting part and the second contacting part electrically connected to corresponding places on the circuit board.

2. The rotary switch as in claim 1, wherein the pedestal further includes a pierced hole formed at a central portion thereof, and the pivotal-connecting part extends from an inner edge of the pierced hole; the pivotal-connecting bodies of the rotative body are hook-shaped and are in correspondence with a protruding edge of said pedestal; wherein the hook-shaped pivotal-connecting bodies are engaged with and pivotally connected to the pivotal-connecting part.

3. The rotary switch as in claim 1, wherein the pedestal further includes a pierced hole formed at a central portion thereof; the first contacting part and the second contacting part extending into the pierced hole and being electrically coupled to the circuit board.

4. The rotary switch as in claim 1, said circuit board further having a conducting hoop contacted with the first contacting part, and a plurality of connecting points formed on a circle being coaxial with the conducting hoop, wherein the second contacting part contacts with one of the connecting points.

5. The rotary switch as in claim 1, further comprising a shell fixed on the rotative body being synchronously rotatable with the rotative body.

6. The rotary switch as in claim 5, wherein the shell further includes a projection extending from a periphery thereof, the pedestal has a stop plate extending from a periphery thereof, said stop plate being positioned on a rotating path of the projection for stopping synchronous rotation of the shell and the rotative body.

7. The rotary switch as in claim 5, wherein the shell has at least two pairs of stop parts extending longitudinally from a periphery thereof and at least one fixed-connecting part; the rotative body has at least two stop bodies corresponding to the two pairs of stop parts and at least one fixed-connecting component corresponding to the fixed-connecting parts; each pair of the stop bodies clips to the corresponding stop part for rotating the shell synchronously with the rotative body, the fixed-connecting component being engaged with the fixed-connecting parts.

8. The rotary switch as in claim 5, further comprising a collocating structure received between the shell and the rotative body; the shell and the rotative body respectively forming a pierced hole at a central portion thereof, the collocating structure extends partly through the pierced hole of the shell and a bottom end of the collocating structure being electrically coupled to the circuit board through the pierced hole of the rotative body.

9. The rotary switch as in claim 8, wherein the collocating structure includes an operation body set between the shell and the rotative body and a multi-direction switching body connected electrically to the circuit board; the operating body being mechanically connected to the multi-direction switching body.

* * * * *